United States Patent [19]

Matsunaga

[11] 4,199,116

[45] Apr. 22, 1980

[54] RECOILER FOR USE IN A SLITTING LINE HAVING A ROTATABLE DRUM WITH REMOTELY EXPANDABLE SIDE WALLS

[75] Inventor: Douglas S. Matsunaga, Vernon Hills, Ill.

[73] Assignee: Braner Enterprises, Inc., Schiller Park, Ill.

[21] Appl. No.: 913,591

[22] Filed: Jun. 8, 1978

[51] Int. Cl.[2] ..... B65H 75/24

[52] U.S. Cl. ..... 242/63; 242/72 R; 242/74.1

[58] Field of Search ..... 242/56.2–56.7, 242/56.9, 72 R, 72 B, 72.1, 78.1, 78.3, 74.1, 63

[56] References Cited

U.S. PATENT DOCUMENTS

| | | | |
|---|---|---|---|
| 331,803 | 12/1885 | Lumsden | 242/63 |
| 3,878,999 | 4/1975 | Daves | 242/72 R X |
| 4,078,739 | 3/1978 | Noe | 242/74.1 X |
| 4,093,140 | 6/1978 | Matsunaga | 242/75.2 X |

FOREIGN PATENT DOCUMENTS

| | | | |
|---|---|---|---|
| 1171698 | 6/1964 | Fed. Rep. of Germany | 242/63 |

*Primary Examiner*—John M. Jillions

*Attorney, Agent, or Firm*—Oltsch, Knoblock & Hall

[57] ABSTRACT

A recoiler for use in a slitting line upon which multiple strands of slit material are wound. The recoiler includes a rotatable drum having expandable side walls which are shiftable between expanded and retracted positions during drum rotation.

10 Claims, 3 Drawing Figures

RECOILER FOR USE IN A SLITTING LINE HAVING A ROTATABLE DRUM WITH REMOTELY EXPANDABLE SIDE WALLS

SUMMARY OF THE INVENTION

This invention relates to a recoiler for use in a slitting line and will have specific application to an improved recoiler in which the drum thereof can be diametrically expanded and retracted during rotation when in use in a slitting operation.

The recoiler of this invention is of the type for use in practicing the method disclosed in U.S. patent application Ser. No. 770,804 filed Feb. 22, 1977, which will become U.S. Pat. No. 4,093,140 on June 6, 1978. The recoiler includes a rotatable drum upon which strands of slit sheet material are coiled after passing through the slitter forming a part of the slitting line. Relative movement or slippage between the recoiler drum and a least one or more of the coiled strands of sheet material allows the strands to be wound at substantially the same linear speed thereby eliminating appreciable sagging of the strands between the slitter and recoiler. In this invention the side wall parts of the recoiler drum can be shifted outwardly or inwardly to increase or decrease the diameter of the drum during its rotation without interruption of the slitting operation. Additionally, a remote means is utilized for releasing the coiled strands from secured engagement with the recoiler drum after the slit material is initially wound upon the drum in preparation for the recoiling operation.

Accordingly, it is an object of this invention to provide a recoiler which is for use in a slitting line and which includes means for remotely expanding the side walls of the drum during the slitting operation without interrupting the rotation of the drum.

Another object of this invention is to provide a recoiler having a drum which is rotatable relative to one or more strands of slit material coiled about the drum during the slitting operation.

Another object of this invention is to provide a recoiler for use in a slitting line having remotely expandable and retractable side wall parts.

Still another object of this invention is to provide a recoiler which is for use in a slitting line and which includes means for remotely releasing the end edges of the slit coiled material from securement to the drum in preparation for the slitting operation.

Other objects of this invention will become apparent upon reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

Figure 1:
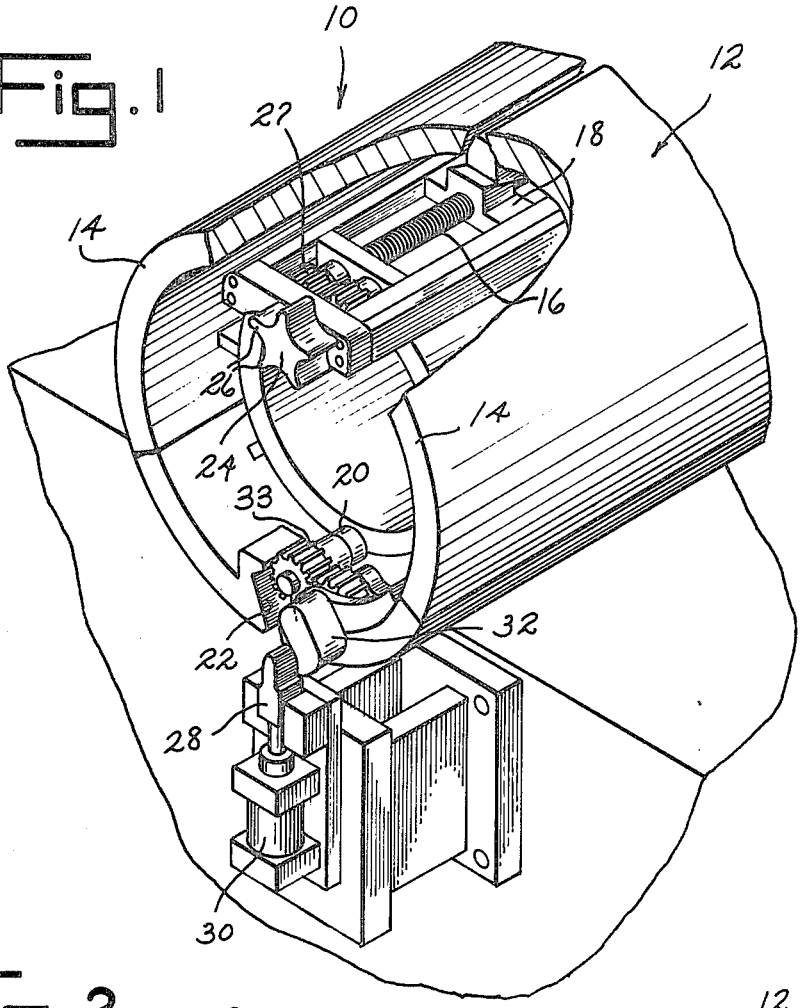
FIG. 1 is a perspective view of the drum of the recoiler with portions broken away for illustration and showing the release of the locking means by which the end of the slit sheet material is secured to the drum in preparation for the slitting operation.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Recoiler 10 illustrated in the figures includes a drum 12 which is rotatable about a horizontal axis. A motor (not shown) is drive-connected to drum 12 for the purpose of providing the drum with rotation. A brake (not shown) is preferably associated with motor in order to control the rotational speed and to stop the movement of drum 12. Drum 12 includes a pair of side wall parts 14 which are pivotally mounted to expand and contract radially relative to the axis of rotation of drum 12, thus increasing and decreasing the effective diameter of the drum. Drum 12 includes an actuator screw 16 which extends substantially the length of drum 12 at one peripheral edge. Screw 16 carries a plurality of wedging parts 18 (only one set shown). Wedging parts 18 protrude between side wall parts 14 of drum 12 and upon rotation of screw 16 serve to cam or force the side wall parts into an outward pivoted expandable position to increase the effective diameter of the drum. Springs (not shown) are connected to side wall parts 14 for the purpose of retracting the side wall parts to reduce the effective diameter of drum 12 upon reverse rotation of screw 16 and the consequential withdrawal of wedging parts 18 from between the side wall parts.

A gripper bar 20 is also carried by recoiler drum 12. Gripper bar 20 is inset from the outer periphery of drum 12 with a gripper slot 22 extending to the bar. The end of the slit sheet material is inserted into gripper slot 22 and gripper bar 20 rotated into pinching contact with the sheet material to secure the material to recoiler drum 12. As thus far described, recoiler 10 is of a commonly used, well-known design.

Figure 2:
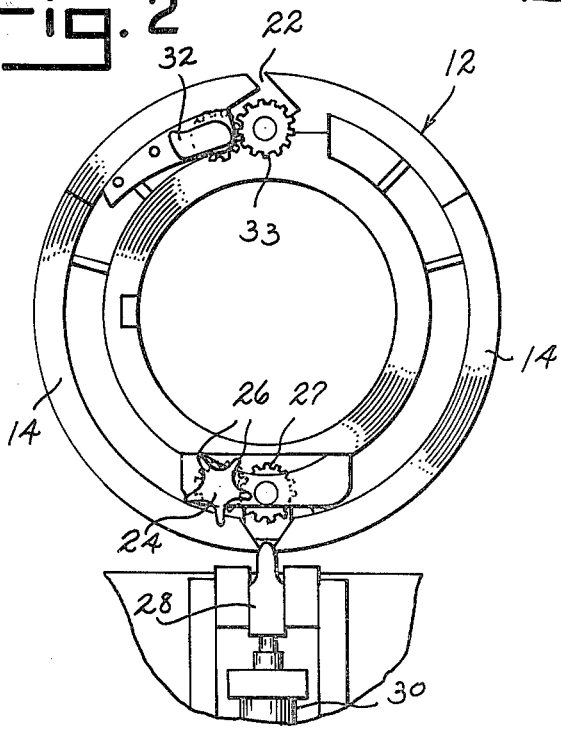
FIG. 2 is an end view of the recoiler drum illustrating the means for expanding the side wall parts of the drum.
Figure 3:
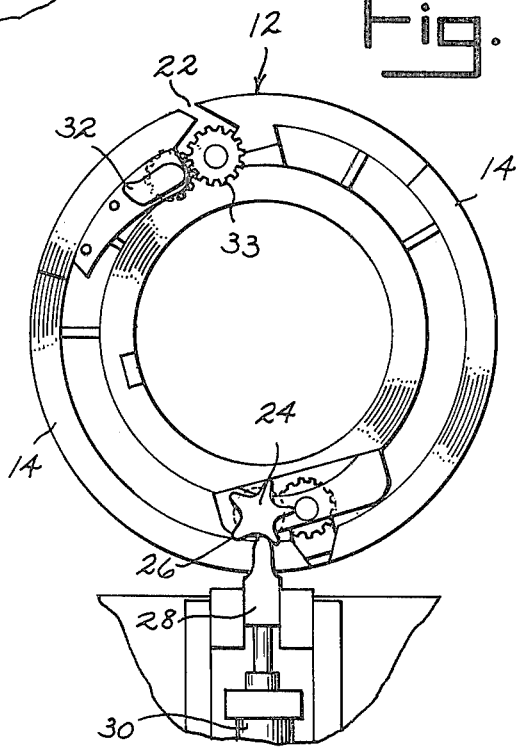
FIG. 3 is an end view of the recoiler drum showing a trip means in operative position for expanding the side wall parts during drum rotation.

The improvement of this invention relates to the means by which screw 16 and gripper bar 20 can be selectively rotated or turned for the purpose of varying the effective diameter of the drum or to release the secured end of the sheet material during drum rotation. A contact member 24 having a plurality of radially extending fingers 26 is secured by gears 27 to one end of screw 16. Contact member 24 protrudes from the periphery of drum 12 at its free or unsupported end. A trip part 28 is mounted to the rod of a piston of a pneumatic cylinder 30. Cylinder 30 which constitutes a part of recoiler 10 is mounted at a fixed location relative to drum 12 and serves upon actuation to shift trip part 28 from its non-operative or retracted position illustrated in FIG. 2 into its operative or extended position as shown in FIGS. 1 and 3. When in its operative position, trip part 28 is located within the path of movement of contact member 24 which rotates with drum 12. As drum 12 is rotated by its motor, a finger 26 of contact member 24 will be brought into contact with trip part 28 in its operative position, causing the finger to be cammed over the trip part and screw 16 turned a selected angular amount. This movement of screw 16 in turn causes movement of wedging parts 18 and the expansion or retraction of side wall parts 14 of recoiler drum 12, depending upon the direction of rotation of the drum.

Upon the next revolution of drum 12 the next adjacent finger 26 of contact member 24 will engage the extended trip part 28 and screw 16 again is turned a selected angular distance. Sequential contact between contact member fingers 26 and trip part 28 serve to progressively expand or retract side wall parts 14 of the recoiler drum without interrupting the rotative movement of the drum. When side wall parts 14 of drum 12 have been expanded or retracted a given selected amount, cylinder 30 is actuated causing trip part 28 to be shifted into its non-operative position out of the path of movement of contact member 24. As explained in U.S. Pat. No. 4,093,140, incorporated herein by reference, it may be necessary, and in fact usually is necessary, to increase the effective diameter of recoiler drum 12 during the slitting operation so as to increase the frictional resistance between the outer surface of the drum and the inner windings of the coiled strands of the slit material in order to maintain rotation of the coils upon the drum. This is accomplished in recoiler 10 by shifting trip part 28 into its operative position so as to contact fingers 26 of contact member 24 as drum 12 rotates. The direction of turn of the threads of screw 16 is such that upon rewinding rotation of drum 12 the engagement between contact member 24 and trip part 28 will cause the expansion of drum side wall parts 14.

A tab 32 is secured by gears 33 to one end of gripper bar 20 at preferably a generally diametrical location from contact member 24. When gripper bar 20 is rotated into its locking position to secure the end of the slit sheet material to drum 12, tab 32 connected thereto will be extended and positioned so as to contact trip part 28 when located in its operative position by actuation of cylinder 30. Upon rotation of drum 12, extended tab 32 will contact trip part 28 and be cammed into its own retracted or release position causing rotation of gripper bar 20 and the release of the end of the coiled slit sheet material carried upon drum 12. Once tab 32 is rotated into its release position, cylinder 30 can be actuated to shift part 28 into its retracted position until it is desired to expand or otherwise modify the effective diameter of the drum 12.

It is to be understood the invention is not to be limited to the details above given but may be modified within the scope of the appended claims.

What I claim is:

1. In a recoiler for use in a slitting line for cutting sheet material including a rotatable drum having expandable side parts for varying the diameter of said drum, movable means carried by said drum and contacting said side parts for urging the side parts into progressively expandable positions wherein the diameter of said drum is increased, screw means carried by said drum for shifting said movable means upon screw means rotation to urge said side parts into progressive expandable positions, the improvement comprising a contact member secured to said screw means, trip means spacedly located from said drum for contacting said contact member upon rotation of the drum to cause rotation of said screw means whereby the diameter of said drum will increase during drum rotation, releasable gripping means carried by said drum for securing the end edge of said sheet material to the drum, contact means carried by said gripping means for releasing the gripping means upon rotation of the drum, said trip means also for contacting said contact means upon drum rotation to cause rotation of the contact means to release the end edge of said sheet material.

2. The recoiler of claim 1 wherein said trip means includes a trip part and means for shifting said trip part into and out of the path of contact with said contact member whereby said drum diameter can be expanded at selected times during drum rotation.

3. The recoiler of claim 2 wherein said drum has an axis of rotation and said screw means parallels said axis.

4. The recoiler of claim 1 wherein said trip means includes a trip part and means for shifting said trip part into and out of the path of contact with said contact means whereby said sheet material end edge will be released from said gripping means at a selected time during drum rotation.

5. The recoiler of claim 1 wherein said drum includes an axis of rotation, said contact member and said contact means being angularly spaced apart relative to said axis.

6. In a recoiler for use in a slitting line for cutting sheet material including a rotatable drum having retractable side parts for varying the diameter of said drum, movable means carried by said drum and contacting said side parts for urging the side parts into progressively retractable positions wherein the diameter of said drum is decreased, screw means carried by said drum for shifting said movable means upon screw means rotation to urge said side parts into progressive retractable positions, the improvement comprising a contact member secured to said screw means, trip means spacedly located from said drum for contacting said contact member upon rotation of the drum to cause rotation of said screw means whereby the diameter of said drum will decrease during drum rotation, releasable gripping means carried by said drum for securing the end edge of said sheet material to the drum, contact means carried by said gripping means for releasing the gripping means upon rotation of the drum, said trip means also for contacting said contact means upon drum rotation to cause rotation of the contact means to release the end edge of said sheet material.

7. The recoiler of claim 6 wherein said trip means includes a trip part and means for shifting said trip part into and out of the path of contact with said contact member whereby said drum diameter can be retracted at selected times during drum rotation.

8. The recoiler of claim 7 wherein said drum has an axis of rotation and said screw means parallels said axis.

9. The recoiler of claim 6 wherein said trip means includes a trip part and means for shifting said trip part into and out of the path of contact with said contact means whereby said sheet material end edge will be released from said gripping means at a selected time during drum rotation.

10. The recoiler of claim 6 wherein said drum includes an axis of rotation, said contact member and said contact means being angularly spaced apart relative to said axis.

* * * * *